US006213414B1

(12) United States Patent
Stier et al.

(10) Patent No.: US 6,213,414 B1
(45) Date of Patent: Apr. 10, 2001

(54) FUEL INJECTOR

(75) Inventors: Hubert Stier, Asperg; Guenther Hohl, Stuttgart, both of (DE)

(73) Assignee: Bobert Bosch GmbH, Stuttgart (DE)

( * ) Notice: Subject to any disclaimer, the term of this patent is extended or adjusted under 35 U.S.C. 154(b) by 0 days.

(21) Appl. No.: 09/561,517

(22) Filed: Apr. 28, 2000

(30) Foreign Application Priority Data

Apr. 28, 1999 (DE) ..... 199 19 313

(51) Int. Cl.[7] ..... B05B 1/30

(52) U.S. Cl. ..... 239/584; 239/453; 239/533.7; 251/57

(58) Field of Search ..... 239/102.2, 45.3, 239/533.2, 533.7, 533.9, 584, 585.1, 533.12, 533.8; 251/57

(56) References Cited

U.S. PATENT DOCUMENTS 4,322,055 * 3/1982 Baumann ..... 251/57
4,728,074 * 3/1988 Igashira et al. ..... 239/584 X
5,417,142 * 5/1995 Lohmann ..... 251/57 X
5,803,361 * 9/1998 Horiuchi et al. ..... 239/533.8 X

FOREIGN PATENT DOCUMENTS 195 00 706 7/1996 (DE) .

* cited by examiner

*Primary Examiner*—Patrick Brinson
*Assistant Examiner*—Steven J. Ganey
(74) *Attorney, Agent, or Firm*—Kenyon & Kenyon

(57) ABSTRACT

A fuel injector has an actuator for generating a lifting movement and a lift translator filled with a hydraulic medium and deformable in the lifting direction, for transferring the lifting movement of the actuator to a valve needle, provision being made for a compensating chamber for the hydraulic medium, the compensating chamber being connected to an interior space of the lift translator via a throttle opening and enclosed by an elastic casing. Thus, temperature-related quasistatic deformations of actuator, lift translator, and/or valve needle can be compensated for by an exchange of the hydraulic medium between the interior space of the lift translator and the compensating chamber, while the comparatively fast lifting movements of the actuator are transmitted to the valve needle essentially without damping.

11 Claims, 2 Drawing Sheets

FUEL INJECTOR

FIELD OF THE INVENTION

The present invention relates to a fuel injector having an actuator for generating a lifting movement and a lift translator (lift transfer element) filled with a hydraulic medium and deformable in the lifting direction, for transferring the lifting movement of the actuator to a valve needle.

BACKGROUND INFORMATION

German Patent No. 195 00 706 describes a fuel injector. In this context, provision is made for a lift translator or travel transformer which converts a relatively small actuator travel, for example, of a piezoelectric actuator, into a longer lift of the valve needle. In this context, the expansion of the actuator is introduced into an amplifier chamber via a working piston of the lift translator, and transmitted to the valve needle via a lift piston, the valve executing a lift which is increased in the ratio of the piston areas bordering the amplifier chamber at the end faces. To compensate for temperature influences, wear, and manufacturing tolerances on the actuator travel, the amplifier chamber is provided with a defined leak, which is implemented by a ring gap between the piston and a valve-housing wall, and has a sufficiently high resistance to flow so that the movements of the actuator are transmitted to the valve needle in an essentially undamped manner. Used as hydraulic medium of the lift transmission is the fuel itself, diesel fuel in the case of German Patent No. 195 00 706. However, this creates the problem that the defined leak must be very small because of the low viscosity of the fuel. If the intention is for the known fuel injector to be used for Otto spark ignition engines, the further problem arises that the gasoline boils at comparatively low temperatures and can then no longer work as hydraulic medium because of the formation of bubbles.

SUMMARY OF THE INVENTION

The fuel injector according to the present invention has a compensating chamber for the hydraulic medium, the compensating chamber being connected to an interior space of the lift translator via a throttle opening and enclosed by a casing, and the fuel injector having the advantage that quasistatic deformations of the actuator because of temperature influences can be compensated for by an exchange of the hydraulic medium between the interior space of the lift translator and the compensating chamber. By choosing a sufficiently small throttle opening, however, the hydraulic medium contained in the lift translator acts as an incompressible liquid during the relatively fast actuator actuation so that the fast movements of the actuator are transmitted to the valve needle in an essentially undamped manner.

The fuel injector according to the present invention has the advantage that the hydraulic medium can be selected independently of the fuel so that the hydraulic medium can have a high boiling point and a relatively high viscosity. In this manner, the hydraulic medium can be prevented from evaporating. A higher viscosity permits a larger opening diameter of the throttle opening, which, because of this, can be manufactured in a simpler manner from a standpoint of production engineering.

The preferably elastic casing of the compensating chamber is preferably composed of a thin-walled metal body which is welded to the lift translator in a liquid-tight manner. The compensating chamber can radially surround a small-diameter section of the lift translator, thereby enabling a compact design.

The outer wall of the lift translator is preferably designed as a bellows. This has the advantage for the outside wall to be deformable only in the lifting direction and not in the radial direction. Because of this, the lifting movements of the actuator are transmitted to the valve needle without damping.

Suitable as hydraulic medium is a liquid which boils at high temperature so that the hydraulic medium is prevented from evaporating. The diameter of the throttle opening is preferably selected as a function of the viscosity of the hydraulic medium in such a manner that the lifting movement of the actuator is transmitted in an essentially undamped manner; however, quasistatic deformations are compensated for by exchange of the hydraulic medium with the elastic compensating chamber.

The actuator is preferably a stacked piezoelectric actuator permitting lifting movements which are defined in time and space.

The fuel injector according to the present invention is particularly suitable for an injection system for an Otto spark ignition engine, since gasoline is not suited as hydraulic medium of the lift transmission because of the low boiling point.

DETAILED DESCRIPTION

Figure 1:
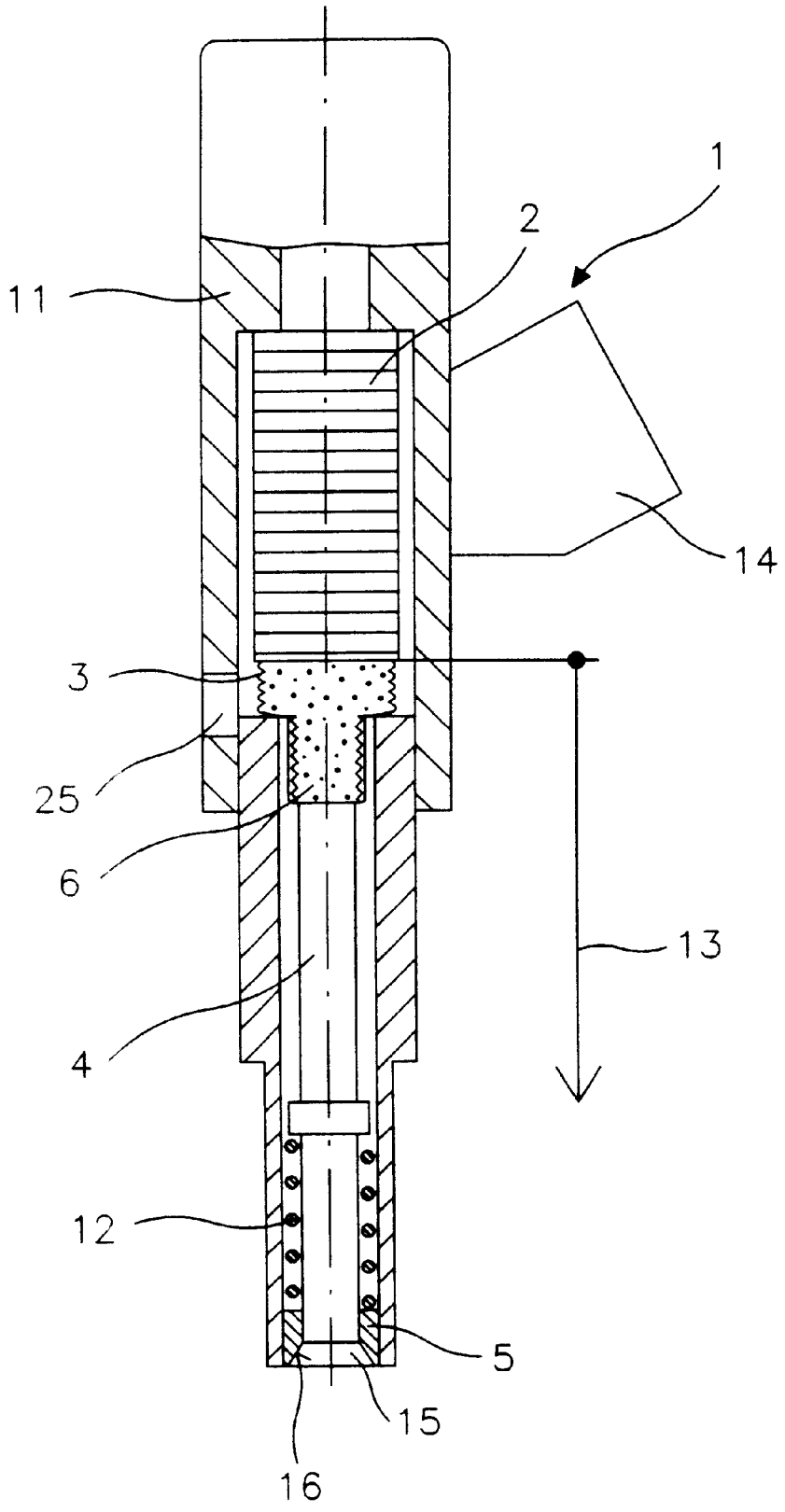
FIG. 1 shows a longitudinal section through an exemplary embodiment of a fuel injector according to the present invention in a simplified representation.

FIG. 1 shows an exemplary embodiment of a fuel injector 1 according to the present invention in a longitudinal section. A housing 11 accommodates a, for example, stacked piezoelectric actuator 2 in a radial bore, the piezoelectric actuator being caused to generate defined lifting movements (schematically represented by an arrow 13) via an electric control device (not shown). The electric control signal for controlling actuator 2 is supplied via a plug-in connection 14. The hydraulic connection is carried out, for example, via a cross bore 25. A hydraulic lift translator 3 transmits the lifting movement from actuator 2 to an axially movable valve needle 4. A valve-closure member 15 joined to valve needle 4, together with a valve-seat face 16 formed on a valve seat 5, forms a sealing seat. A restoring spring 12 keeps the sealing seat closed.

Figure 2:
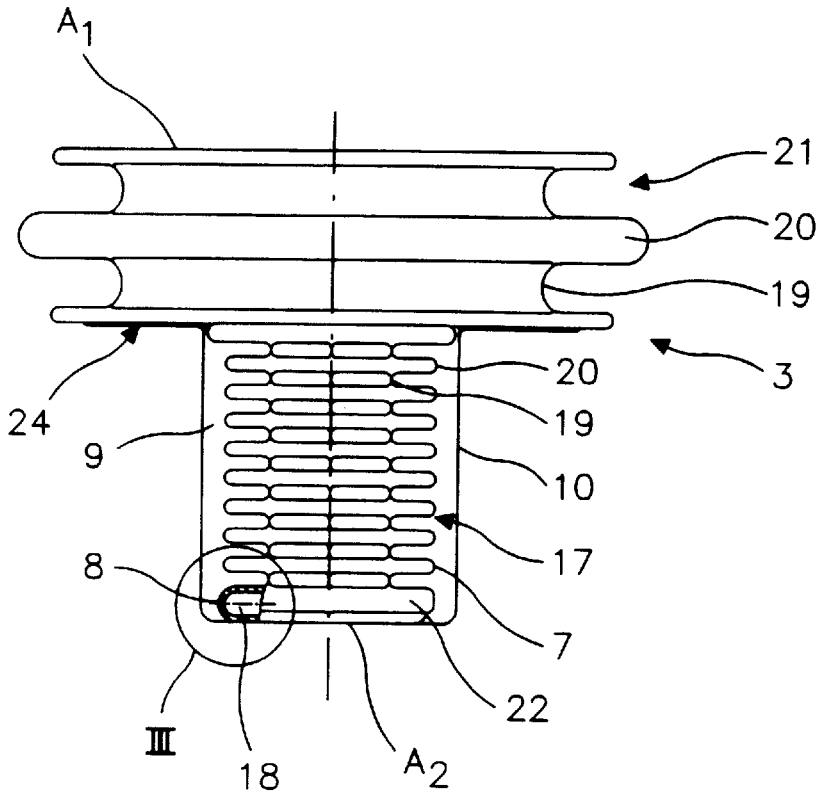
FIG. 2 shows an enlarged representation of a lift translator of the fuel injector of FIG. 1.

FIG. 2 shows lift translator 3 of fuel injector 1 in an enlarged representation. In this context, actuator 2, via a small lift $h_1$, acts upon a large area $A_1$ of lift translator 3, which is designed as a bellows 7 filled with a hydraulic medium 6, and, because of the hydraulic filling, generates a correspondingly increased lift $h_2=h_1 \cdot A_1/A_2$ at the smaller area $A_2$ at the end facing away from actuator 2, and transmits lift $h_2$ to valve needle 4. In this context, bellows 7 must be designed sufficiently rigidly so that a motion is possible only in the lifting direction but not in the radial direction. Thus, the forces can be transmitted from piezoelectric actuator 2 to valve needle 4 dynamically and essentially without damping. In this context, bellows 7 has a plurality of alternating regions 19 and 20 which are narrowed and widened, respectively, in the radial direction. In section 21 adjoining actuator 2, in the exemplary embodiment over three widened regions 20 and two narrowed regions 19, bellows 7 has a larger diameter. Contiguously joining up thereto is a small-diameter section 17 which has a reinforcement 22 at the extremity.

Figure 3:
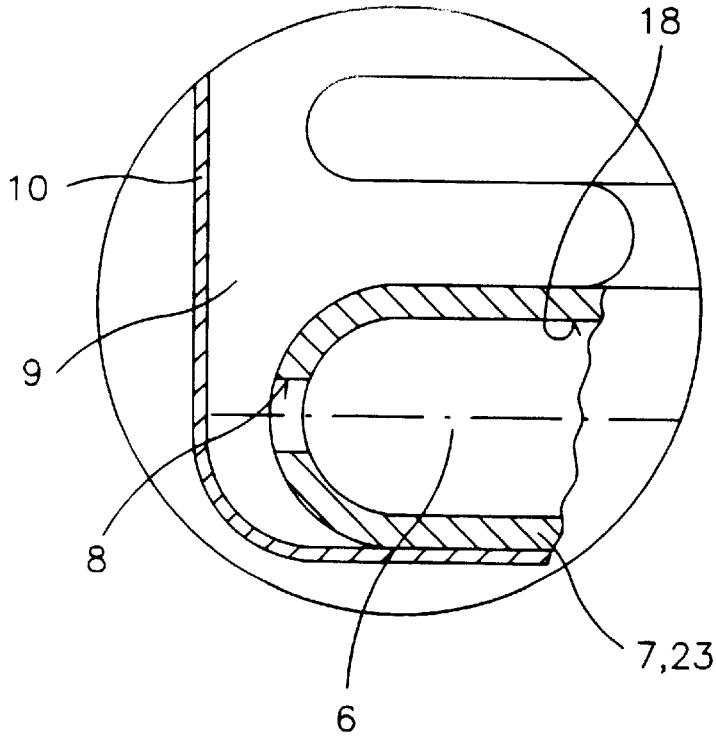
FIG. 3 shows an enlarged representation of section III in FIG. 2.

Small-diameter section 17 of lift translator 3 is radially surrounded by an elastic casing 10 made of thin-walled metallic material and welded to lift translator 3 in a liquid-tight manner. In this context, casing 10 can be welded to a shoulder 24 which forms the transition between section 21 having a larger diameter and small-diameter section 17. Casing 10 encloses a closed compensating chamber 9, which is connected to an interior space 18 of lift translator 3 via a throttle opening 8 so that hydraulic medium 6 can flow back and forth between interior space 18 of lift translator 3 and compensating chamber 9 through throttle opening 8, as follows particularly from FIG. 3.

Dividing wall 23 between compensating chamber 9 and interior space 18 is formed by bellows 7. Thus, compensating chamber 9 forms an elastic reservoir for hydraulic medium 6 for compensating for quasistatic influences on the travel, particularly by temperature-related linear expansion, but also because of manufacturing tolerances or symptoms of wear. However, throttle opening 8 is selected, as a function of the viscosity of used hydraulic medium 6, to be small enough so that hydraulic medium 6 contained in lift translator 3 represents an incompressible liquid during a short time interval. Thus, actuator movements having a duration in the millisecond range are transmitted without a relevant pressure compensation with compensating chamber 9 taking place. However, thermal expansions of actuator 2 (>1 second) can be compensated for by liquid displacements. In this context, the connected system composed of actuator 2, lift translator 3, and valve needle 4, is preloaded by restoring spring 12 (FIG. 1).

Fuel injector 1 according to the present invention allows a medium different from the fuel to be used as hydraulic medium 6 in lift translator 3. In this manner, a hydraulic medium 6 can be selected which is optimally suitable for the purpose of application with regard to viscosity and evaporation properties. Suited as hydraulic medium is, in particular, a relatively viscous liquid having a high boiling point such as a hydraulic oil.

Fuel injector 1 according to the present invention allows slow deformations in the lifting direction, which are caused, for example, by temperature influences, to be compensated for, while the comparatively fast lifting movements of actuator 2 are transmitted to valve needle 4 dynamically and essentially without damping in an amplified manner.

What is claimed is:

1. A fuel injector for a fuel-injection system of an internal combustion engine, comprising:

a valve-seat face;

a valve needle forming a sealing seat together with the valve-seat face;

a valve-closure member situated at the valve needle;

an actuator for generating a lifting movement;

a lift transfer element, filled with a hydraulic medium and deformable in a lifting direction, for transferring the lifting movement of the actuator to the valve needle, the lift transfer element having an interior space;

a casing; and a compensating chamber for the hydraulic medium, the compensating chamber being connected to the interior space of the lift transfer element via a throttle opening, the compensating chamber being enclosed by the casing.

2. The fuel injector according to claim 1, wherein the casing has an elastic design.

3. The fuel injector according to claim 1, wherein the casing includes a thin-walled metal body.

4. The fuel injector according to claim 1, wherein the casing is attached to the lift transfer element in a liquid-tight manner.

5. The fuel injector according to claim 1, wherein the compensating chamber radially surrounds a small-diameter section of the lift transfer element.

6. The fuel injector according to claim 1, further comprising a dividing wall situated between the interior space of the lift transfer element and the compensating chamber, the dividing wall being formed as a bellows.

7. The fuel injector according to claim 1, wherein the hydraulic medium is a liquid which boils at a high temperature.

8. The fuel injector according to claim 1, wherein the hydraulic medium is a hydraulic oil.

9. The fuel injector according to claim 1, wherein a diameter of the throttle opening is a function of a viscosity of the hydraulic medium and is such that the lift transfer element transmits the lifting movement of the actuator to the valve needle in a substantially undamped manner, and wherein the hydraulic medium flowing one of into and out of the compensating chamber compensates for temperature-related deformations of at least one of the actuator, the lift transfer element and the valve needle in the lifting direction.

10. The fuel injector according to claim 1, wherein the actuator is a piezoelectric actuator.

11. The fuel injector according to claim 1, wherein the actuator is a magnetostrictive actuator.

* * * * *